United States Patent [19]

Matson

[11] 4,163,346

[45] Aug. 7, 1979

[54] GRINDING MACHINE CONTROL

[75] Inventor: Charles B. Matson, Cincinnati, Ohio

[73] Assignee: Cincinnati Milacron Inc., Cincinnati, Ohio

[21] Appl. No.: 874,312

[22] Filed: Feb. 1, 1978

[51] Int. Cl.[2] ..... B24B 49/16; B24B 53/14

[52] U.S. Cl. ..... 51/165.77; 51/165.87; 51/165.92; 125/11 R

[58] Field of Search ..... 51/165 R, 165.77, 165.71, 51/165.87, 165.88, 165.92, 5 D; 125/11 R

[56] References Cited

U.S. PATENT DOCUMENTS

| | | | |
|---|---|---|---|
| 3,056,243 | 10/1962 | Flanders | 51/165.77 |
| 3,913,277 | 10/1975 | Hahn | 51/165.77 |
| 4,118,900 | 10/1978 | Moritomo et al. | 51/165.77 |

FOREIGN PATENT DOCUMENTS

| | | | |
|---|---|---|---|
| 424698 | 10/1974 | U.S.S.R. | 51/165.87 |

*Primary Examiner*—Harold D. Whitehead
*Attorney, Agent, or Firm*—Thomas M. Farrell

[57] ABSTRACT

A tangential grinding machine has a variable grinding feed rate which is dependent upon the length of the cutting or grinding path which occurs between the grinding wheel and a workpiece. The variable feed rate accomodates fluctuations in grinding wheel and workpiece dimensions to control the grinding time and optimize stock removal rates.

9 Claims, 9 Drawing Figures

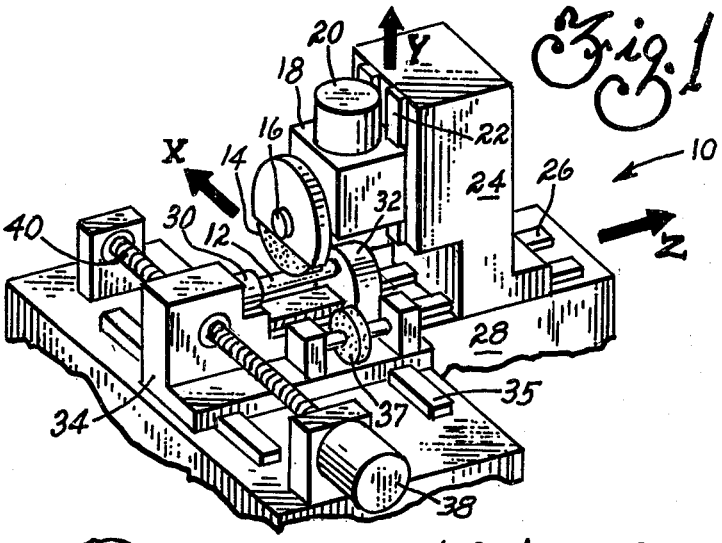
Fig. 1
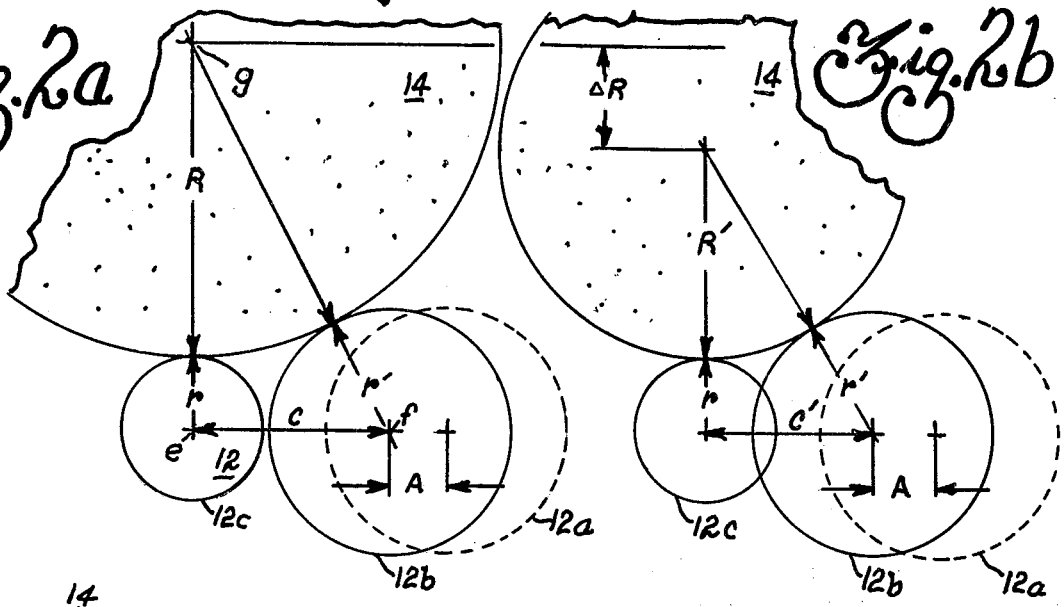
Fig. 2a
Fig. 2b
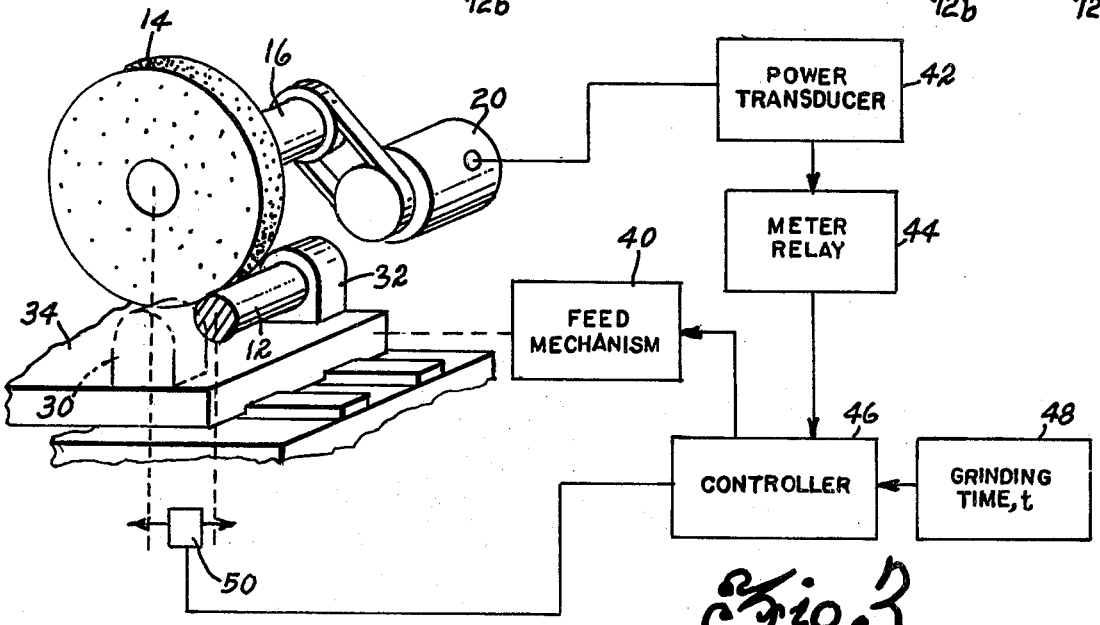
Fig. 3

GRINDING MACHINE CONTROL

BACKGROUND

The present invention relates to grinding machines and will be disclosed in connection with a control apparatus which varies the infeed rate of a tangential grinding machine to optimize grinding operations whenever the grinding wheel or workpiece sizes are variable.

Tangential grinders are known in the art and are characterized in that the workpiece feed vector is non-coincident with the rotary axis of the abrasive wheel. Generally, the relative infeed motion between the grinding wheel and workpiece in a tangential grinder is tangent to the periphery of the grinding wheel axis. The relative motion may be accomplished by the workpiece feeding tangent to the periphery of the grinding wheel or vice versa. Alternatively, the motion between these two elements may be skewed. The most prominent contemporary example of a tangential grinder is a surface grinder.

Like all grinders, tangential grinders are plagued with the problem of wheel breakdown, a problem which is virtually inherent in the grinding process. This breakdown is a function of the force generated between the grinding wheel and workpiece in machining operation. It is commonly expressed in terms of stock removal rate per inch and G-ratio. As a consequence of wheel breakdown, the abrasive wheel dimensions vary from the their original size to some smaller "stub out" dimension. Depending upon the original size of the abrasive wheel, the dimensional change may be quite substantial. For example, a wheel with an original 36 inch diameter might be used upon a machine until a "stub out" diameter of 26 inches is reached, utilizing five inches of wheel radius.

Prior art tangential grinding machines move the workpiece relative to the abrasive wheel at a fixed velocity during the period these two elements are in grinding engagement. This fixed velocity feed has resulted in several problems in tangential grinding. As the grinding wheel is reduced in size, workpiece contact with the wheel is delayed as the workpiece (or grinding wheel, as the case may be) must be moved through a greater distance before contact with the grinder wheel (or workpiece) commences. Thus, a greater portion of the feed stroke is non-productive (grinding air). If the rapid advance portion of the stroke is fixed, significant increases in non-productive cycle time result without offsetting advantages. Additionally, and perhaps more significantly, prior art machine control concepts have required exceedingly high stock removal rates in the diminished cutting path length whenever a large amount of stock is removed with a worn wheel. This has resulted because the prior art machines have fixed feed velocities through variable cutting path lengths, the cutting path being reduced in length in proportion to the grinding wheel wear. Further, stock material often fluctuates in its dimensions. Hot forged cylindrical workpieces, for example, often exhibit wide variations in their diameters. Thus, the cutting path often fluctuates even with a constant wheel size and is not predictable.

Prior art machines have been relegated to compromising between one of two trade off situations. If the grinding feed velocity is set for a new wheel size, exceedingly high stock removal rates will be experienced after the wheel undergoes wear. While the initially suitable, relatively rapid, feed rate reduces cycle time, continued use of this rate may result in multiple problems after the wheel experiences wear. Such problems may include, inter alia, accelerated wheel breakdown, depreciated workpiece finish and even workpiece sizing problems. On the other hand, if the machine rate is set for the worn wheel size, reduced cycle time will be experienced with a new wheel, and a slower cycle time will result. Quality control considerations frequently dictate that the worse case situation be accomodated; and this latter, slower cycle time is frequently adopted.

Applicant has alleviated the above mentioned problems with a novel and unique control scheme that contains the advantages of each of the formerly available trade off situations while eliminating the disadvantages associated with each. Consequently, many of the compromises inherent in prior art machines are removed and a new and improved grinder control results.

SUMMARY OF THE INVENTION

The invention relates to grinding machines and more particularly to an infeed control which is especially suitable for a tangential grinding machine. The tangential grinding machine has a grinding wheel and means for effectuating relative tangential movement between the wheel and a workpiece along a tangential cutting path for selective grinding contact therebetween. The length of the tangential grinding path, which varies as the grinding wheel experiences breakdown, is detected and this parameter is utilized to control the rate of the relative tangential movement.

The infeed control senses the relative positions of the grinding wheel and the workpiece when grinding action is initiated to measure the grinding path with each grinding cycle. As the grinding wheel wears and is reduced in dimension, the infeed control reduces the rate of relative grinding wheel-workpiece movement in order to optimize the grinding period. The overall grinding cycle is also reduced by varying the grinding cycle commencement position with each grinding cycle.

BRIEF DESCRIPTION OF THE DRAWINGS

FIG. 1 is a perspective view of a tangential grinding machine utilizing one form of the present invention.

FIG. 2*a* is a diagrammatic view of a grinding wheel and a workpiece illustrating a tangential grinding path for a new grinding wheel.

FIG. 2*b* is a diagrammatic view of the grinding wheel in the workpiece of FIG. 2*a* illustrating the change in tangential grinding path length as the grinding wheel experiences wear.

FIG. 3 is schematic depiction of one control scheme used to control the grinding machine of FIG. 1.

DETAILED DESCRIPTION OF THE PREFERRED EMBODIMENTS

Figure 4:
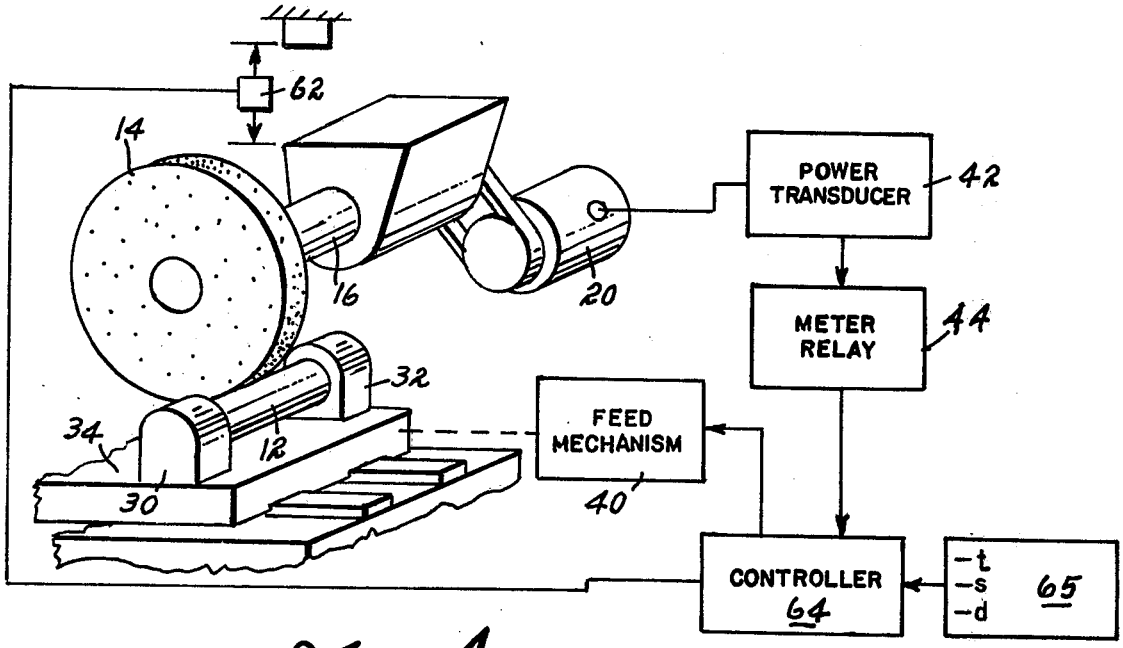
FIG. 4 is a schematic depiction of an alternate control scheme used to control the grinding machine of FIG. 1.

Referring now to the drawings and to FIG. 1 in particular, a tangential grinding machine 10 is shown operating upon a cylindrical workpiece 12. The grinding machine 10 has a grinding wheel 14 rotatable about a spindle 16 contained in a housing 18. The spindle 16, and consequently the grinding wheel 14 is rotatably powered by an electrical motor 20 in a conventional manner. The housing 18 is slidable in the Y direction along a way system 22 which is attached to a column 24. The column 24 is itself slidable in the Z direction, parallel to the spindle 16 axis, along way system 26 supported upon the machine base 28. A dresser assembly 37 is mounted upon a slide 34 for common movement with the head and tail stocks 30 and 32. At selected intervals (e.g. after a predetermined number of grinding cycles) the dresser assembly 37 is interfaced with the grinding wheel 14 by further advancement of the slide 34 in the X-direction along ways 35.

The workpiece 12 is carried between respective head and tail stocks 30 and 32 also supported upon the slide 34. The slide 34 is movable in the X direction along a way system 35 under the impetus of an electrical stepping motor 38, the motor 38 rotatably powering a screw or feed mechanism 40. The directions X, Y and Z are mutually perpendicular and form a mutually perpendicular triordinant system.

FIG. 2*a* depicts a new grinding wheel 14 and a cylindrical workpiece 12. The workpiece 12 is illustrated in three positions as it is moved from right to left in the illustration. The workpiece position 12*a* at the extreme right represents the cycle commencement position for the slide 34; middle workpiece position 12*b* represents the point of initial contact with the grinding wheel 14; and position 12*c* at the extreme left represents the finish size position in which the workpiece is directly beneath the grinding wheel center line. As represented by the reduction in the diametrical workpiece dimension between positions 12*b* and 12*c*, stock is removed as the workpiece passes through a grinding path C, the path C being defined in this particular application as the distance between workpiece centerpoints, e and f, in the grind commencement and the finish size positions 12*b* and 12*c*, respectively. As should be readily apparent from a comparison of FIGS. 2*a* and 2*b*, the grinding path C diminishes as the grinding wheel 14 wears from the new size radius R and approaches its stub-out radius R'. The grinding path between positions 12*b* and 12*c* is reduced from the distance C in FIG. 2*a* to the distance C' in FIG. 2*b*.

The invention optimizes the grinding cycle time with stock removal to insure quality. The velocity of the feed slide (or grinding wheel if it is moved to effectuate the relative movement) is varied as the grinding path is altered to maintain a substantially constant grinding time. One control scheme is illustrated in schematic depiction of FIG. 3. After the slide 34 commences from its cycle start position 12*a*, a load detection means, shown as a power or watt transducer 42, monitors the electrical power drawn by the spindle motor 20. The transducer 42 generates a signal which is proportional to load upon the grinding wheel 14. When contact is made between the workpiece 12 and grinding wheel 14, the resulting power surge in the motor 20 will be detected by the transducer 42 and reflected in its output which is applied to a controller 46 through a meter relay 44. The controller 46 also receives inputs from a potentiometer 48 and a position sensor 50. The position sensor 50 may take any of several conventional forms, as for example, an LVDT, a voltage divider or a FARRAND scale. The distance detected by the position sensor 50 at the instance in which the transducer 42 indicates workpiece—grinding wheel contact represents the grinding path C or the distance between the workpiece center positions in the grind commencement and finish size positions 12*b* and 12*c*. The potentiometer 48 is set at a value representing the desired time to be utilized in a predetermined stock removal. Since the desired velocity is proportional to the quotient of the distance, C, and the time, t, these inputs are mathematically combined to produce an output signal which is input to the feed mechanism 40.

Figure 5:
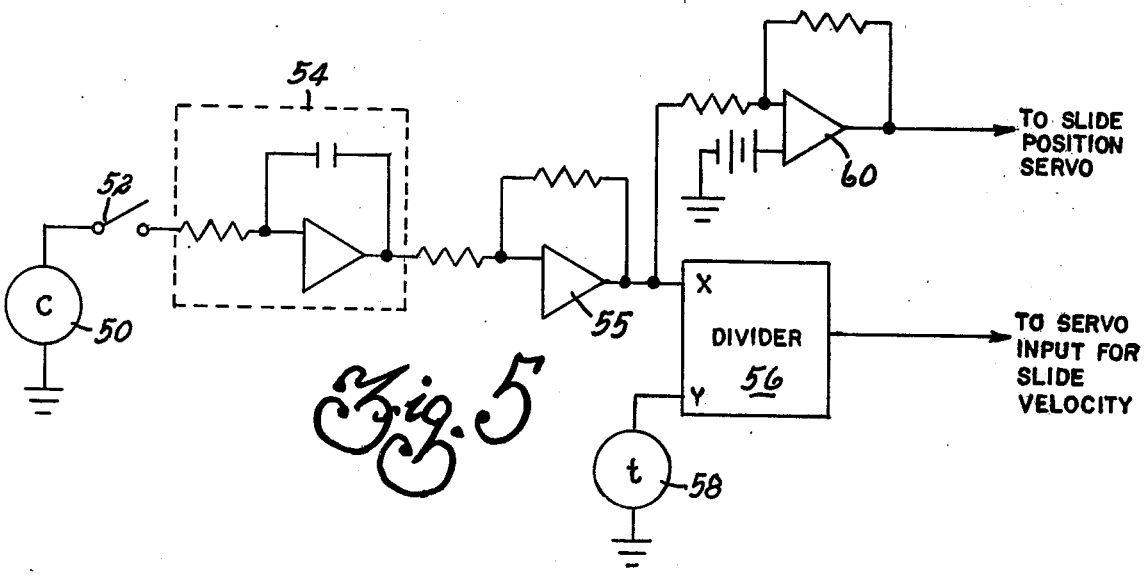
FIG. 5 is circuit diagram illustrating one method of implementing the control scheme of FIG. 3.

FIG. 5 shows a circuit which might be employed to implement the control scheme in FIG. 3. The grinding path length C, is measured by the position sensor 50 (FARRAND scale, voltage divider, LVDT, etc.) and input to a storage element 54. Whenever the transducer 42 detects workpiece—grinding wheel contact, its output is used to open contact 52 associated with meter relay 44. The cutting path length now represented by the stored value of C is applied to a divider 56 through a buffer amplifier 55. The divider 56 has a second input from a thumbwheel switch or potentiometer 58 which applies a signal representative of the desired time period for the predetermined stock removal. The divider 56 supplies, as its output, a signal representative of the quotient of the cutting path length and the time signals. This signal which is proportional in magnitude to the desired relative tangential velocity, V, between the grinding wheel and workpiece and is used to control the grinding feed mechanism.

The output of buffer amplifier 55 is also applied to an operational amplifier 60. A second input to this amplifier 60 provides a signal proportional to the desired distance A, between the workpiece feed commencement and wheel contact positions. As will be readily appreciated from the illustrations of FIGS. 2*a* and 2*b*, if the cycle commencement position 12*a* remains fixed, the non-productive time required for advancing the workpiece to the grinding wheel contact position will increase with wheel wear. This non-productive time is reduced in present day machines with "gap eliminator" circuitry. The present invention reduces this period even further by combining the gap eliminator circuit with a variable cycle commencement position 12*c*. The distance, C, between the finish size position, 12*c*, and the initial wheel-workpiece contact point or grind commencement position, 12*b*, is added to the desired distance between cycle commencement and grind commencement positions, A, to establish a variable cycle commencement position 12*a*.

Referring once again to FIGS. 2*a* and 2*b*, it can be seen that whenever, as in the preferred embodiment, the grinding wheel and workpiece are cylindrical, a definite geometric relationship exists between the grinding wheel radius and the grinding path length C. Imaginary lines connecting the workpiece centerpoints e and f, in respective positions 12*c* and 12*b*, and the grinding wheel centerpoint, g, form a right triangle having the length of the cutting path C as one side. According to pythagorean theorem the square of the hypotenuse (R+r'), defined by the sum of the grinding wheel and unmachined workpiece diameters is equal to the sum of the squares of the lengths of the other two sides. This relationship may be rearranged and expressed mathematically as follows:

$$C^2=(R+r')^2-(R+r)^2$$

where

C is the distance travelled by the part during grinding

R is the grinding wheel radius r' is the initial part radius and r is the final part radius With known grinding wheel and workpiece dimensions, the above equation can be solved for C, the grinding path length.

In many tangential grinding applications, the total stock removal is such that relatively small dimensional changes occur in the workpiece radius between rough and finish sizes. In these applications, it may be assumed without significant error that the initial and finish workpiece dimensions are approximately equal; in other words:

$$d' \simeq d$$

or $$d'+d=2d$$

where d is the initial workpiece diameter and d' is the final diameter With this assumption, the value of C may be expressed as:

$$C \simeq \sqrt{S/2(D+d)}$$

Where S is the stock to be removed on the workpiece, or $$S=(d-d')$$

Since the velocity is the quotient of the length C divided by the time t, the desired velocity may be expressed as:

$$V \simeq \sqrt{S/2(D+d)}/t$$

If the grinding wheel diameter is 25 inches and the workpiece diameter is 4 inches and 0.005 inches of stock are removed, the above assumption would result in a 0.004% error. A 0.09% error would result with a 15 inch wheel diameter, 0.5 inch workpiece diameter and a 0.055 inch stock removal. It is thus seen that the above proximations are acceptable in a wide range of grinding applications.

FIG. 4 is a schematic illustration of a control scheme to estimate the grinding path length by measurement of the change in the grinding wheels dimensions. A signal representative of the grinding wheel diameter is generated from a wheel size sensor 62 and applied to a controller 64. The controller 64 also has inputs from a plurality of potentiometers represented by block 65 representative of the final part size, d, the stock to be removed, s; and the desired grinding time, t. The controller 64 mathematically combines the parameters in accordance with the above equation and delivers a control signal representative of the desired velocity, V, to the feed mechanism 40.

Figure 6:
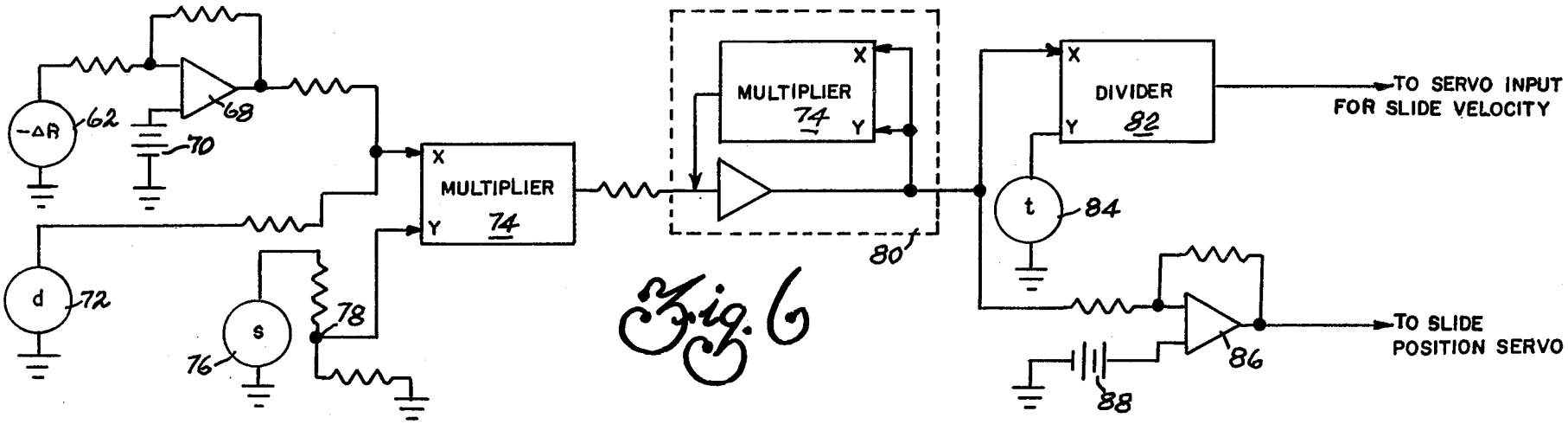
FIG. 6 is a circuit diagram illustrating one method of implementing the control scheme of FIG. 4.

FIG. 6 is a circuit diagram illustrating one method to achieve the control scheme of FIG. 4. A signal representative of the wheel size radius change, ΔR, is input to a summation amplifier 68 from the position sensor 62. The sensor 62 may for example, detect the position of a compensation slide used for the grinding wheel 14. This signal from sensor 62 is subtracted from a second fixed signal input representative of the new grinding wheel diameter from a voltage source 70. The output of amplifier 68, representative of the presently measured grinding wheel diameter, is combined with still another input from a potentiometer 72. Potentiometer 72, which may be a thumbwheel switch, is set at a value representative of the desired workpiece diameter, d. A combined signal, resulting from the addition of the signals from the outputs of amplifier 68 and potentiometer 72 is applied as a first input to a multiplier unit 74. A second input to the multiplier 74 representative of the desired stock removal, S, to the multiplier unit 74 is generated by potentiometer 76 via a voltage divider 78. The multiplier unit 74, which is a commerically available unit, is in turn connected to a square root generator 80 which then modifies its input signal to produce an output which approximates the distance C. The square root generator 80 output is then applied to a voltage divider unit 82 where this signal is combined with a second divider signal 82 input representative of the desired grinding time, t, from a thumbwheel switch or potentiometer 84. The divider 82 output, proportional to the quotient of the input of the square root generator 80 and potentiometer 84 is then applied to a servo input for control of the slide 34.

The output of the square root generator 80 is also applied to a summation amplifier 86 where its value is added to that of a voltage source 88. The voltage source 88 is proportional to the value A, that is, the distance between cycle commencment and grinding wheel contact positions, 12*a* and 12*b*.

Figure 8:
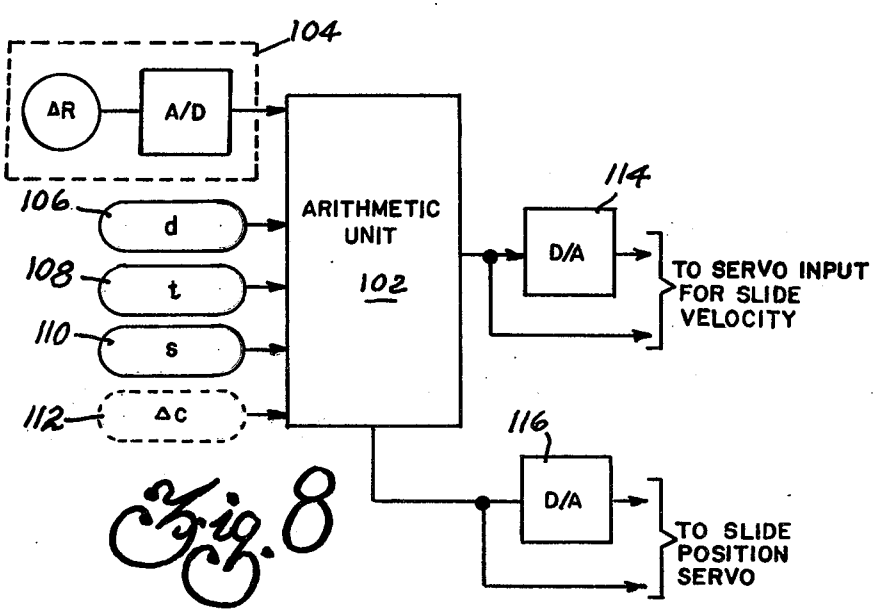
FIG. 8 is a schematic representation of an alternate method of implementing the control scheme of FIG. 4.
Figure 7:
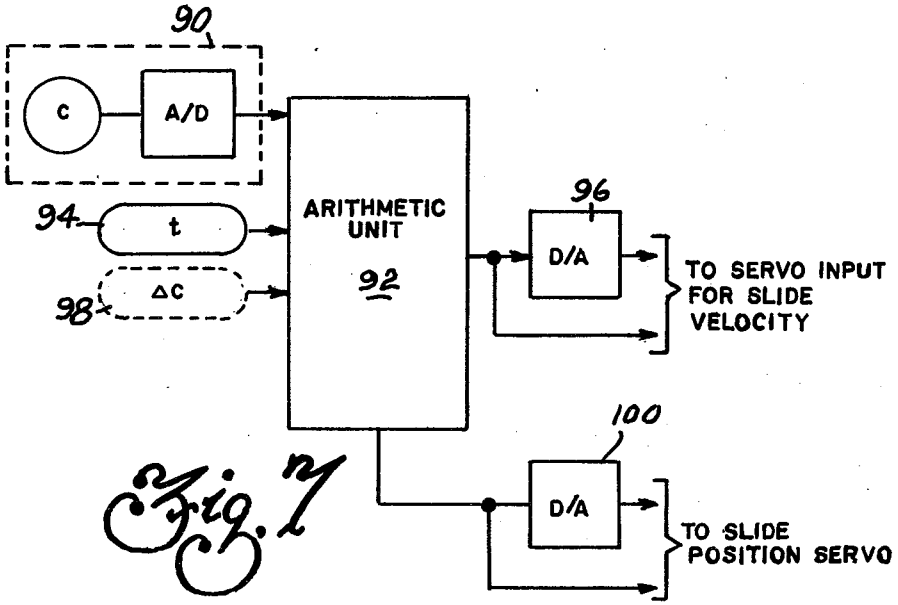
FIG. 7 is a schematic representation of an alternate method of implementing the control scheme of FIG. 3.

FIGS. 7 and 8 schematically illustrate alternate digital schemes to implement the control schemes of FIGS. 3 and 4 respectively. In FIG. 7, an analogue signal representing the grinding path length C is generated and converted to a digital signal in block 90. The output of block 90, which should also be an absolute encoder, is applied to an arithmetic unit 92. A second input to the arithmetic unit 92 is applied from a digital thumbwheel switch 94. The arithmetic unit 92 provides a digital output signal proportional to the quotient of the inputs from unit 90 and thumbwheel switch 94 which is then applied to a feed mechanism either directly as a digital signal or indirectly as an analogue signal through a digital to analogue converter 96. A second thumbwheel switch 98 applies an input to arithmetic unit 92 representative of the desired wheelhead advance portion of the grinding cycle, C. This signal is mathmetically added to the measured value C from unit 90 and applied to the slide table position apparatus, either directly in digital form or indirectly through a digital to analogue converter 100.

An arithmetic unit 102 in FIG. 8 receives inputs from an encoder 104 which provides a signal representative of the changes ΔR, in the radial dimension of the grinding wheel, and from a plurality of thumbwheel switches 106, 108, 110, and 112. The thumbwheel switches 106, 108, 110, and 112 provides signals representative of the workpiece diameter, desired grinding time, stock removal rate and wheelhead advance distance respectively. The arithmetic unit 102 mathematically combines these inputs according to the equation:

$V=\sqrt{S/2(D'-d)/t}$ to provide outputs representative of the desired velocity and wheelhead advance. The velocity output may be applied to the infeed apparatus directly in digital form or indirectly through a digital-to-analogue converter 114. Similarly, the wheelhead retraction signal may be applied to the table position directly in digital form or indirectly through a digital-to-analogue converter 116.

It is also desirable to control the rate of relative advancement between the grinding wheel 14 and dresser assembly 37 to accomodate wheel wear. Since, in the preferred embodiment, the dresser assembly 37 is mounted upon the slide 34, the circuitry of FIGS. 5 and 6 may also be used to regulate the rate of relative grinding wheel-dresser assembly movement during the dressing operation when two elements are interfaced.

Although the present invention has been described in conjunction with the preferred embodiments, it is to be understood that modification and variations may be resorted to without departing from the spirit of the invention as those skilled in the art will readily understand. Such modifications and variations are considered to be within the view and scope of the present invention as defined by the appended claims.

I claim:

1. In a tangential grinding machine having a base, a grinding wheel, and means for effectuating a relative tangential infeed movement between a workpiece and the grinding wheel along a grinding path of varying length, an apparatus for controlling the tangential infeed rate, comprising:

(a) means for detecting variations in the contact portion of the tangential grinding path length; and (b) means for controlling the rate of relative tangential movement between the grinding wheel and the workpiece in accordance to the detected variations in the grinding path length.

2. An apparatus as recited in claim 1 wherein the detecting means includes means for sensing the relative positions of the grinding wheel and the workpiece when the grinding action is initiated therebetween.

3. An apparatus as recited in claim 1 wherein the effectuating means moves the workpiece toward the grinding wheel, the movement commencing during each grinding cycle from a cycle commencement position and further including means for varying the cycle commencement position.

4. An apparatus as recited in claim 1 wherein the controlling means decreases the rate of relative tangential movement between the grinding wheel and the workpiece as the tangential grinding path diminishes in length.

5. An apparatus as recited in claim 1 wherein the relative movement between the grinding wheel and workpiece is varied at a rate directly proportional to the detected variations in the tangential grinding path length.

6. An apparatus as recited in claim 5 wherein the relative movement between the grinding wheel and the workpiece is further varied in accordance with at least one additional parameter, the additional parameter being selectively variable.

7. An apparatus as recited in claim 6 wherein the relative movement between the grinding wheel and workpiece is inversely proportional to the magnitude of the additional parameter.

8. In a tangential grinding machine having a base, a grinding wheel supported upon the base, and means for selectively effectuating relative tangential movement between the grinding wheel and a workpiece for selective grinding contact therebetween, a control apparatus comprising:

(a) means for generating a signal representative of the distance between the grinding wheel-workpiece contact position and the finish size position; and (b) means responsive to said signal for controlling the rate of relative tangential movement between the workpiece and the abrasive wheel.

9. A tangential grinding machine, comprising:

(a) a base;

(b) a grinding wheel supported upon the base;

(c) a dressing assembly supported upon the base; the dressing assembly being relatively movable with respect to the grinding wheel;

(d) means for effectuating relative tangential movement and selective interfacing between the dressing assembly and the grinding wheel along a predetermined path;

(e) means for generating a signal representative of the interface distance between the grinding wheel and dresser assembly along the predetermined path;

(f) means responsive to the generated signal for regulating the rate of relative movement between the grinding wheel and the dresser assembly.

* * * * *